US005116484A

United States Patent [19]

Smegal

[11] Patent Number: 5,116,484

[45] Date of Patent: May 26, 1992

[54] HYDRODENITRIFICATION PROCESS

[75] Inventor: John A. Smegal, Houston, Tex.

[73] Assignee: Shell Oil Company, Houston, Tex.

[21] Appl. No.: 653,216

[22] Filed: Feb. 11, 1991

Related U.S. Application Data

[63] Continuation-in-part of Ser. No. 606,414, Oct. 31, 1990, abandoned.

[51] Int. Cl.[5] ..... C10G 23/02; C10G 45/00

[52] U.S. Cl. ..... 208/254 H; 208/59; 208/177

[58] Field of Search ..... 208/59, 254 H

[56] References Cited

U.S. PATENT DOCUMENTS

| | | | |
|---|---|---|---|
| 3,392,112 | 7/1968 | Bercik et al. | 208/210 |
| 3,642,612 | 2/1972 | Girotti et al. | 208/89 |
| 3,766,058 | 10/1973 | Hensley | 208/210 |
| 3,876,530 | 4/1975 | Frayer et al. | 208/210 |
| 4,012,330 | 3/1977 | Brewster | 252/33.6 |
| 4,016,069 | 4/1977 | Christman et al. | 208/210 |
| 4,016,070 | 4/1977 | Christman et al. | 208/210 |
| 4,048,060 | 9/1977 | Riley | 208/210 |
| 4,166,026 | 8/1979 | Fukui et al. | 208/210 |
| 4,392,945 | 7/1983 | Howard et al. | 208/210 |
| 4,406,779 | 9/1983 | Hensley et al. | 208/254 H |
| 4,421,633 | 12/1983 | Shih et al. | 208/59 |
| 4,431,526 | 2/1984 | Simpson et al. | 208/211 |
| 4,447,314 | 5/1984 | Banta | 208/89 |
| 4,520,128 | 5/1985 | Morales et al. | 502/210 |
| 4,530,911 | 7/1985 | Ryan et al. | 502/74 |
| 4,534,852 | 8/1985 | Washecheck et al. | 208/89 |
| 4,540,483 | 9/1985 | Simpson et al. | 208/216 |
| 4,613,425 | 9/1986 | Higashi et al. | 208/89 |
| 4,619,759 | 10/1986 | Myers et al. | 208/210 |
| 4,728,417 | 3/1988 | Aldag et al. | 208/216 R |
| 4,738,767 | 4/1988 | Ward | 208/111 |
| 4,776,945 | 10/1988 | Washechecke t al. | 208/89 |
| 4,886,594 | 12/1989 | Miller | 208/210 |

*Primary Examiner*—Helane Myers

[57] ABSTRACT

In a process for the hydrogenation of nitrogen-containing hydrocarbons in a hydrocarbon feedstock, the feedstock is contacted at a temperature between about 575° F. and about 775° F. and a pressure between about 600 psi and about 2500 psi in the presence of added hydrogen with a first catalyst bed containing a hydrotreating catalyst containing nickel, tungsten and optionally phosphorous supported on an alumina support, and, after contact with the first catalyst bed, the hydrogen and feedstock without modification is passed from the first catalyst bed to a second catalyst bed where it is contacted at a temperature between about 575° F. and about 775° F. and a pressure between about 600 psi and about 2500 psi with a hydrotreating catalyst containing nickel, molybdenum and optionally phosphorous supported on an alumina support.

15 Claims, No Drawings

HYDRODENITRIFICATION PROCESS

This is a continuation-in-part of application Ser. No. 606,414, filed Oct. 31, 1990 now abandoned.

FIELD OF THE INVENTION

This invention relates to a hydrotreating process for the removal of nitrogen-containing compounds from petroleum fractions.

BACKGROUND OF THE INVENTION

Nitrogen-containing compounds in petroleum fractions can adversely affect end products. For example, nitrogen compounds can adversely affect the storage stability and octane value of naphthas and may poison downstream catalysts. Nitrogen removal improves air quality to same extent, since it lowers the potential for $NO_x$ formation during subsequent fuel combustion. Crude and other heavy petroleum fractions are typically subjected to hydrodentrification prior to being subjected to further processing.

Applicant has developed a "stacked" or multiple bed hydrotreating system for removal of nitrogen-containing feedstocks comprising a Ni-W-optionally P/alumina catalyst "stacked" on top of a Ni-Mo-optionally P/alumina catalyst which offers activity advantages over the individual catalysts for hydrodentrification. A more active catalyst can be operated at a lower temperature to obtain the same degree of nitrogen conversion as a less active catalyst. A lower operating temperature will prolong catalyst life and decrease operating expenses.

The prior art discloses several examples of stacked catalyst beds used to hydroprocess petroleum fractions. The particular selection of catalysts to be used in stacked beds for a particular process can be as unpredictable as catalysts itself.

In co-pending U.S. patent application Ser. No. 544,445, filed June 27, 1990, there is disclosed the used of a stacked bed of Ni-W-optionally P/alumina catalyst on top of a Co and/or Ni-Mo-optionally P/alumina catalysts for use in a hydrotreating process to saturate aromatics in diesel boiling-range hydrocarbon feedstocks.

U.S. Pat. No. 3,392,112 discloses a two-stage hydrotreating process for sulfur-containing petroleum fractions wherein the first stage contains a sulfur-resistant catalyst such as nickel-tungsten supported on alumina and the second stage catalyst is reduced nickel composite with a diatomaceous earth such as keiselguhr.

U.S. Pat. No. 3,766,058 discloses a two-stage process for hydrodesulfurizing high-sulfur vacuum resides. In the first stage some of the sulfur is removed and some hydrogenation of feed occurs, preferably over a cobalt-molybdenum catalyst supported on a composite of ZnO and $Al_2O_3$. In the second stage the effluent is treated under conditions to provide hydrocracking and desulfurization of asphaltenes and large resin molecules contained in the feed, preferably over molybdenum supported on alumina or silica, wherein the second catalyst has a greater average pore diameter than the first catalyst.

U.S. Pat. No. 3,876,530 teaches a multi-stage catalytic hydrodesulfurization and hydrodememtallization of residual petroleum oil in which the initial stage catalyst has a relatively low proportion of hydrogenation metals and in which the final stage catalyst has a relatively high proportion of hydrogenation metals.

U.S. Pat. No. 4,016,067 discloses a dual bed hydrotreating process wherein in the first bed the catalytic metals are supported on delta or theta phase alumina and wherein both catalysts have particular requirements of pore distribution.

U.S. Pat. No. 4,016,069 discloses a two-stage process for hydrosulfurizing metal- and sulfur-containing asphaltenic heavy oils with an interstage flashing step and with parallel feed oil bypass around the first stage.

U.S. Pat. No. 4,016,070 also discloses a two-stage process with an interstage flashing step.

U.S. Pat. No. 4,012,330 teaches a two-bed hydrotreating process with additional hydrogen injection between the beds.

U.S. Pat. No. 4,048,060 discloses a two-stage hydrodesulfurcation and hydrodemetallization process utilizing a different catalyst in each stage, wherein the second stage catalyst has a larger pore size than the first catalyst and a specific pore size distribution.

U.S. Pat. No. 4,166,026 teaches a two-step process wherein a heavy hydrocarbon oil containing large amounts of asphaltenes and heavy metals is hydrodemetallized and selectively cracked in the first step over a catalyst which contains one or more catalytic metals supported on a carrier composed mainly of magnesium silicate. The effluent from the first step, with or without separation of hydrogen-rich gas, is contacted with hydrogen in the presence of a catalyst containing one or more catalytic metals supported on a carrier preferably alumina or silica-alumina having a particular pre volume and pore size distribution. This two-step method is claimed to be more efficient than a conventional process wherein a residual oil is directly hydrodesulfurized in a one-step treatment.

U.S. Pat. No. 4,392,945 discloses a two-stage hydrorefining process for treating heavy oils containing certain types of organic sulfur compounds by utilizing a specific sequence of catalysts with interstage removal of $H_2S$ and $NH_3$. A nickel-containing conventional hydrorefining catalyst is present in the first stage. A cobalt-containing conventional hydrorefining catalyst is present in the second stage.

U.S. Pat. No. 4,406,779 teaches a two-bed reactor for hydrodentrification. The catalyst in the first bed can comprise, for example, phosphorus-promoted nickel and molybdenum on an alumina support and the catalyst for the second bed can comprise, for example, phosphorus-promoted nickel and molybdenum on a silica-containing support.

U.S. Pat. No. 4,421,633 teaches a multi-catalyst bed reactor containing a first bed large-pore catalyst having majority of its pores much larger than 100 Å in diameter and a second bed of small-pore catalyst having a pore size distribution which is characterized by having substantially all pores less than 80 Å in diameter.

U.S. Pat. No. 4,431,526 teaches a multi-catalyst bed system in which the first catalyst has an average pore diameter at least about 30 Å larger than the second catalyst. Both catalyst have pore size distributions wherein at least about 90% of the pore volume is in pores from about 100 to 300 Å.

U.S. Pat. No. 4,447,314 teaches a multi-bed catalyst system in which the first catalyst has at least 60% of its pore volume in pores having diameters of about 100 to 200 Å and a second catalyst having a quadralobe shape in at least 50% of its pore volume in pores having diameters of 30 to 100 Å.

U.S. Pat. Nos. 4,554,852 and 4,776,945 discloses that Ni/Mo/P and Co/Mo catalysts in a stacked bed arrangement provide significant advantages when hydrotreating certain types of coke-forming oils.

SUMMARY OF THE INVENTION

The instant invention comprises a process for the hydrogenation of nitrogen-containing hydrocarbons in a hydrocarbon feedstock having a nitrogen content greater than about 100 ppm which process comprises:

(a) contacting at a temperature between about 575° F. and about 775° C. and a pressure between about 600 psi and about 2500 psi in the presence of added hydrogen said feedstock with a first catalyst bed containing a hydrotreating catalyst comprising nickel, tungsten and optionally phosphorus supported on an alumina support, and (b) passing the hydrogen and feedstock without modification, from the first catalyst bed to a second catalyst bed where it is contacted at a temperature between about 575° F. and about 775° F. and a pressure between about 600 psi and about 2500 psi with a hydrotreating catalyst comprising nickel, molybdenum and optionally phosphorus supported on an alumina support.

The instant process can be operated at lower temperatures than processes using individual hydrodentrification catalysts.

DESCRIPTION OF THE PREFERRED EMBODIMENTS

The instant invention relates to a process for reducing the nitrogen content of a hydrocarbon feedstock by contacting the feedstock in the presence of added hydrogen with a low bed catalyst system at hydrotreating and mild hydrocracking conditions, i.e., at conditions of temperature and pressure and amounts of added hydrogen such that significant quantities of nitrogen-containing hydrocarbons are reacted with hydrogen to produce gaseous nitrogen compounds which are removed from the feedstock.

The feedstock to be utilized is any crude or petroleum fraction containing in excess of 100 parts per million by weight (ppm) of nitrogen in the form of nitrogen-containing hydrocarbons. Examples of suitable petroleum fractions include catalytically cracked light and heavy gas oils, straight run heavy gas oils, light flash distillates, light cycle oils, vacuum gas oils, coker gas oil, synthetic gas oil and mixtures thereof. Typically, the feedstocks that are most advantageously processed by the instant invention are feedstocks for first stage hydrocracking units. These feedstocks will usually also contain from about 0.01 to about 2, preferably from about 0.05 to about 1.5 percent by weight of sulfur present as organosulfur compounds. Feedstocks with very high sulfur contents are generally not suitable for processing in the instant process. Feedstocks with very high sulfur contents can be subjected to a separate hydrodesulfurization process in order to reduce their sulfur to about 0.01–2, preferably 0.05–1.5 percent by weight prior to being processed by the instant process.

The instant process utilizes two catalyst beds in series. The first catalyst bed is made up of a hydrotreating catalyst comprising nickel, tungsten and optionally phosphorous supported on an alumina support and the second catalyst bed is made up of a hydrotreating catalyst comprising nickel, molybdenum and optionally phosphorous supported on an alumina support. The term "first" as used herein refers to the first bed with which the feedstock is contacted and "second" refers to the bed with which the feedstock, after passing through the first bed, is next contacted. The two catalyst beds may be distributed through two or more reactors, or, in the preferred embodiment, they are contained in one reactor. In general the reactor(s) used in the instant process is used in the trickle phase mode of operation, that is, feedstock and hydrogen are fed to the top of the reactor and the feedstock trickles down through the catalyst bed primarily under the influence of gravity. Whether one or more reactors are utilized, the feedstock with added hydrogen is fed to the first catalyst bed and the feedstock as it exits from the first catalyst bed is passed directly to the second catalyst bed without modification. "Without modification" means that no sidestreams of hydrocarbon materials are moved from or added to the stream passing between the two catalyst beds. Hydrogen may be added at more than one position in the reactor(s) in order to maintain control of the temperature. When both beds are contained in one reactor, the first bed is also referred to as the "top" bed and the second bed is also referred to as the "bottom bed."

The volume ratio of the first catalyst bed to the second catalyst bed is primarily determined by a cost effectiveness analysis and the nitrogen and sulfur contents of the feed to be processed. The cost of the first bed catalyst which contains more expensive tungsten is approximately two to three times the cost of the second bed catalyst which contains less expensive molybdenum. The optimum volume ration will depend on the particular feedstock nitrogen and sulfur contents and will be optimized to provide minimum overall catalyst cost and maximum nitrogen removal. In general terms the volume ratio of the first catalyst bed to the second catalyst bed will range from about 1:5 to about 5:1, more preferably from about 1:4 to about 4:1, and most preferably from about 1:3 to about 3:1. In a particularly preferred embodiment the volume of the first catalyst will be equal to or less than the volume of the second catalyst, that is the volume of the first catalyst will comprise about 10 percent to about 50 percent of the total bed volume.

The catalyst utilized in the first bed comprises nickel, tungsten and 0–5% utilized phosphorous (measured as the element) supported on a porous alumina support preferably comprising gamma alumina. It contains from about 1 to about 5, preferably from about 2 to about 4 percent by weight of nickel (measured as the metal); from about 15 to about 35, preferably from about 20 to about 30 percent by weight of tungsten (measured as the metal) and, when present, preferably from about 1 to about 5, more preferably from about 2 to about 4 percent by weight of phosphorous (measured at the element), all per total weight of the catalyst. It will have a surface area, as measured by the B.E.T. method (Brunauer et al, J. Am. Chem. Soc., 60, 309–16 (1938)) of greater than about 100 $m^2/g$ and a water pore volume between about 0.2 to about 0.6, preferably between about 0.3 to about 0.5.

The catalyst utilized in the second bed comprises nickel, molybdenum and 0–5% phosphorous (measured as the element) supported on a porous alumina support preferably comprising gamma alumina. It contains from about 1 to about 5, preferably from about 2 to about 4 percent by weight of nickel (measured as the metal); from about 8 to about 20, preferably from about 12 to about 16 percent by weight of molybdenum (measured as the metal) and, when present, preferably from about 1 to about 5, more preferably from about 2 to about 4 percent by weight of phosphorous (measured as the element), all per total weight of the catalyst. It will have a surface area, as measured by the B.E.T. method (Brunauer et al, J. Am. Chem. Soc., 60, 309-16 (1938)) of greater than about 120 $mu^2/g$ and a water pore volume between about 0.2 to about 0.6, preferably between about 0.3 to about 0.5.

The catalyst utilized in both beds of the instant process are catalysts that are known in the hydrocarbon hydroprocessing art. These catalysts are made in a conventional fashion of described in the prior art, For example porous alumina pellets can be impregnated with solution(s) containing nickel, tungsten or molybdenum and phosphorous compounds, the pellets subsequently dried and calcined at elevated temperatures. Alternately, one or more of the components can be incorporated into an alumina powder by mulling, the mulled powder formed into pellets and calcined at elevated temperature. Combinations of impregnation and mulling can be utilized. Other suitable methods can be found in the prior art. Non-limiting examples of catalyst preparative techniques can be found in U.S. Pat. No. 4,530,911, issued July 23, 1985, and U.S. Pat. No. 4,520,128, issued May 28, 1985, both incorporated by reference herein. The catalyst are typically formed into various sizes and shapes. They may be suitably shaped into particles, chunks, pieces, pellets, rings, spheres, wagon wheels, and polylobes, such as bilobes, trilobes and tetralobes.

The two above-described catalysts are normally presulfided prior to use. Typically, the catalysts are presulfided by heating in $H_2S/H_2$ atmosphere at elevated temperatures. For example, a suitable presulfiding regimen comprises heating the catalysts in a hydrogen sulfide/hydrogen atmosphere (5v $H_2$/95% v $H_2$) for about two hours at about 700° F. Other methods are also suitable for presulfiding and generally comprise heating the catalysts to elevated temperatures (e.g., 400°-750° F.) in the presence of hydrogen and a sulfur-containing material.

The hydrogenation process of the instant invention is effected at a temperature between about 575 ° F. and 775° F., preferably between about 600° F. and about 775° F. under pressures above 40 atmospheres. The total pressure will typically range from about 600 to about 2500 psig. The hydrogen partial pressure will typically range from about 500 to about 2200 psig. The hydrogen feed rate will typically range from about 1000 to about 6000 SCF/BBL. The feedstock rate will typically have a liquid hourly spaced velocity ("LHSV") ranging from 0.1 to about 5, preferably from about 0.2 to about 3.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

The catalysts used to illustrate the instant invention are given in Table 1 below.

TABLE 1

| HYDROGENATION CATALYSTS | | |
|---|---|---|
| Metals, Wt. % | CATALYST A | CATALYST B |
| Ni | 2.99 | 2.58 |
| W | 25.81 | 0 |
| Mo | 0 | 14.12 |
| P | 2.60 | 2.93 |
| Support | gamma alumina | gamma alumina |
| Surface Area, $m^2/g$ | 133 | 164 |
| Water Pore Vol., ml/g | 0.39 | 0.44 |

Properties of the feedstocks utilized to illustrate the instant invention are detailed in Table 2 below.

TABLE 2

| PROPERTIES OF FEEDSTOCK | | |
|---|---|---|
| | FEED A | FEED B |
| Physical Properties | | |
| Density (60° F.) | 0.9460 | 0.9264 |
| Viscosity (70° F.) | 2.48 | 2.09 |
| Molecular Wt. | 218 | 227 |
| Elemental Content | | |
| Hydrogen | 10.485 wt. % | 10.741 wt. % |
| Carbon | 88.684 wt. % | 87.818 wt. % |
| Oxygen | 0.227 wt. % | 0.253 wt. % |
| Nitrogen | 0.203 wt. % | 0.158 wt. % |
| Sulfur | 0.480 wt. % | 0.969 wt. % |
| Basic Nitrogen | 344 ppm | 383 ppm |
| Aromatic Content (wt. %) (Measured by UV absorption) | | |
| Mono | 7.78 | 7.06 |
| Di | 20.21 | 17.46 |
| Tri | 8.41 | 8.01 |
| Tetra | 0.56 | 0.75 |
| Total | 36.96 | 33.28 |
| Boiling Point Distribution | F°. | F°. |
| IBP | 271 | 235 |
| 10 wt. % | 408 | 443 |
| 30 wt. % | 463 | 516 |
| 50 wt. % | 518 | 570 |
| 70 wt. % | 572 | 632 |
| 90 wt. % | 636 | 676 |
| 95 wt. % | 664 | 698 |
| 97 wt. % | 683 | 712 |
| 99 wt. % | 720 | 736 |
| 99.5 wt. % | 743 | 755 |

To illustrate the instant invention and to perform comparative tests, a vertical micro-reactor having a weight of 49.125 inches and an internal volume of 19.1 cubic inches was used to hydrotreat the feedstocks noted in Table 2. Four types of catalyst configurations were tested utilizing the catalysts noted in Table 1: A/B, B/A, A and B. The catalysts were diluted with 60/80 mesh silicon carbide particles in a 1:1 volume ratio of catalyst:carbide and 100 cc of the mixture was used in the catalyst bed. The catalyst were presulfided in the reactor by heating them to about 700° F. and holding at such temperature for about two hours in a 95 vol.% hydrogen-5 vol.% hydrogen sulfide atmosphere flowing at a rate of about 120 liters/hour.

To test the catalysts, the feeds from Table 2 were passed down through the catalyst bed at a liquid hourly space velocity of 1 hour $^{-1}$, a system pressure of 1750 psig and a hydrogen flow rate of about 100 liters/hr. The reactor temperature was adjusted to provide a liquid product containing 5 ppm of nitrogen as measured by chemiluminescence. The catalyst were run for about 600 hours. From the temperature required to obtain 5 ppm nitrogen in the product versus time, it was noted that the catalysts had stabilized at about 200 hours. A best fit line was drawn through the stabilized portions of the curves and the temperatures required for 5 ppm of nitrogen were obtained after a run time of 300 hours and are given in Table 3 below.

TABLE 3

Comparative Hydrodenitrification Results

| Bed Loading* Top Bed Vol./ Bottom Bed. Vol. | Temp. Required for 5 ppm Nitrogen, °F. FEED A | FEED B |
|---|---|---|
| 20A/80B | 660 | 644 |
| 30A/70B | 660 | 637 |
| 100A/0B | 670 | — |
| 0A/100B | 665 | 651 |
| 80B/20A | 668 | — |
| 60B/40A | 672 | — |

*Refers to the volume ratio of catalysts A or B in the catalyst bed. For example, 20A/80B means that the bed contains 20 volume percent of Catalyst A in the top and 80 volume percent of catalyst B in the bottom; 100A/0B means that the catalyast bed is all catalyst A.

As can be seen from the above data, the instant invention provides for enhanced catalyst activity (lower temperature to achieve 5 ppm N) when compared to the individual catalysts and when compared to a stacked bed of catalyst B over catalyst A.

What is claimed is:

1. A process for the hydrodenitrification of nitrogen-containing hydrocarbons in a hydrocarbon feedstock having a nitrogen content greater than about 100 parts per million by weight which process comprises:

(a) contacting at a temperature between about 575° F. and about 775° F. and a pressure between about 600 psi and about 2500 psi in the presence of added hydrogen said feedstock with a first catalyst bed containing a hydrotreating catalyst comprising nickel and tungsten supported on an alumina support, and (b) passing the hydrogen and feedstock without modification, from the first catalyst bed to a second catalyst bed where it is contacted at a temperature between about 575° F. and about 775° F. and a pressure between about 600 psi and about 2500 psi with a hydrotreating catalyst comprising nickel and molybdenum supported on an alumina support.

2. The process of claim 1 wherein the support for the catalyst in the first catalyst bed has a surface area greater than about 100 $m^2/g$ and a water pore volume ranging from about 0.2 to about 0.6 cc/g and the support for the catalyst in the second catalyst bed has a surface area greater than about 120 $m^2/g$ and a water pore volume ranging from about 0.2 to about 0.6 cc/g.

3. The process of claim 2 wherein the supports for both catalysts have water pore volumes ranging between from 0.3 to about 0.5 cc/g.

4. The process of claim 2 wherein the supports for both catalysts comprises gamma alumina.

5. The process of any one of claims 1–4 wherein the catalyst in the first bed the nickel content ranges from about 1 to about 5 percent by weight of the total catalyst, measured as the metal and the tungsten content ranges from about 15 to about 35 percent by weight of the total catalyst, measured as the metal and wherein in the catalyst in the second bed the nickel content ranges from about 1 to about 5 percent by weight of the total catalyst, measured as the metal and the molybdenum content ranges from about 8 to about 20 percent by weight of the total catalysts, measured as the metal.

6. The process of any one of the claims 1–4 wherein in the catalyst in the first bed the nickel content ranges from about 2 to about 4 percent by weight of the total catalyst, measured as the metal and the tungsten content ranges from about 20 to about 30 percent by weight of the total catalyst, measured as the metal and wherein in the catalyst in the second bed the nickel content ranges from about 2 to about 4 percent by weight of the total catalyst, measured as the metal and the molybdenum content ranges from about 12 to about 16 percent by weight of the total catalyst, measured as the metal.

7. The process of claim 1 wherein the hydrodenitrification of the feedstock takes place at a hydrogen partial pressure ranging from about 500 to about 2200 psig, feedstock is provided at a liquid hourly space velocity ranging from about 0.1 to about 5 $hour^{-1}$ and added hydrogen is provided at a feed rate ranging from about 1000 to about 6000 SCF/BBL.

8. The process of claim 1 wherein the catalyst selected from the catalyst in the first catalyst bed, the catalyst in the second catalyst bed and the catalyst in both the first and second catalyst beds additionally comprises phosphorus.

9. The process of claim 8 wherein the support for the catalyst in the first catalyst bed has a surface area greater than about 100 $m^2/g$ and a water pore volume ranging from about 0.2 to about 0.6 cc/g and the support for the catalyst in the second catalyst bed has a surface area greater than about 120 $m^2/g$ and a water pore volume ranging from about 0.2 to about 0.6 cc/g.

10. The process of claim 9 wherein the supports for both catalysts have water pore volumes, ranging between from 0.3 to about 0.5 cc/g.

11. The process of claim 9 wherein the supports for both catalysts comprises gamma alumina.

12. The process of any one of claims 8–11 wherein in the catalyst in the first bed the nickel content ranges from about 1 to about 5 percent by weight of the total catalyst, measured as the metal; the tungsten content ranges from about 15 to about 35 percent by weight of the total catalyst, measured as the metal, and the phosphorus content ranges from about 1 to about 5 percent by weight of the total catalyst, measured as the element and wherein in the catalyst in the second bed the nickel content ranges from about 1 to about 5 percent by weight of the total catalyst, measured as the metal; the molybdenum content ranges from about 8 to about 20 percent by weight of the total catalyst, measured as the metal, and the phosphorus content ranges from about 1 to about 5 percent by weight of the total catalyst, measured as the element.

13. The process of any one of claims 8–11 wherein in the catalyst in the first bed the nickel content ranges from about 2 to about 4 percent by weight of the total catalyst, measured as the metal; the tungsten content ranges from about 20 t about +percent by weight of the total catalyst, measured as the metal; and the phosphorous content ranges from about 2 to about 4 percent by weight of the total catalyst, measured as the element and wherein in the catalyst in the second bed the nickel content ranges from about 2 to about 4 percent by weight of the total catalyst, measured as the metal; the molybdenum content ranges from about 12to about 16 percent by weight of the total catalyst, measured as the metal and the phosphorus content ranges from about 2 to about 4 percent by weight of the total catalyst, measured as the element.

14. The process of claim 8 wherein the hydrodenitrification of the feedstock takes place at a hydrogen partial pressure ranging from about 500 to about 2200 psig, feedstock is provided at a liquid hourly space velocity ranging from about 0.1 to about 5 hour $^{-1}$ and added hydrogen is provided at a feed rate ranging from about 1000 to about 6000 SCF/BBL.

15. The process of claim 8 wherein the temperature is steps (a) and (b) ranges from about 600° F. to about 775° F.

* * * * *